US006141805A

United States Patent [19]

Fisher-Cohen et al.

[11] Patent Number: 6,141,805

[45] Date of Patent: Nov. 7, 2000

[54] EZ NAP

[76] Inventors: Pamela Fisher-Cohen; Rita Montoya, both of 7111 S. Virginia St., #A-17, Reno, Nev. 89511

[21] Appl. No.: 09/059,586

[22] Filed: Apr. 14, 1998

[51] Int. Cl.[7] ..... A47G 9/06

[52] U.S. Cl. ..... 5/420; 5/413 R; 5/419

[58] Field of Search ..... 5/420, 482, 419, 5/485, 413 R, 413 AM; 383/74; 40/6

[56] References Cited

U.S. PATENT DOCUMENTS

| | | | |
|---|---|---|---|
| D. 382,755 | 8/1997 | Knopfler | D6/596 |
| 3,268,922 | 8/1966 | Moxley | 5/420 |
| 4,267,868 | 5/1981 | Lowe | 383/74 X |
| 4,601,076 | 7/1986 | Knobeloch | 5/413 |
| 4,754,512 | 7/1988 | Chao-Yang | 5/482 |
| 4,901,462 | 2/1990 | Wrigley | 40/6 X |
| 4,967,428 | 11/1990 | Browder | 5/482 |
| 5,050,254 | 9/1991 | Murphy | 5/413 |
| 5,099,530 | 3/1992 | Scott | 5/420 |
| 5,172,440 | 12/1992 | Ming | 5/482 |
| 5,467,487 | 11/1995 | Sicard | 5/482 |
| 5,644,807 | 7/1997 | Battistella | 5/419 |

FOREIGN PATENT DOCUMENTS

| | | | |
|---|---|---|---|
| 2446622 | 9/1980 | France | 5/419 |

*Primary Examiner*—Anthony Knight
*Assistant Examiner*—James M. Hewitt
*Attorney, Agent, or Firm*—Patent & Trademark Services; Joseph H. McGlynn

[57] ABSTRACT

A resting mat for use by children which can be rolled up for storage and has a quilted blanket and a pillow pocket attached thereto. In addition, a foam pad, sheathed by a nylon slip cover, is inserted into a body of a casing, and a pillow is inserted into the pillow pocket.

5 Claims, 1 Drawing Sheet

FIG. 1
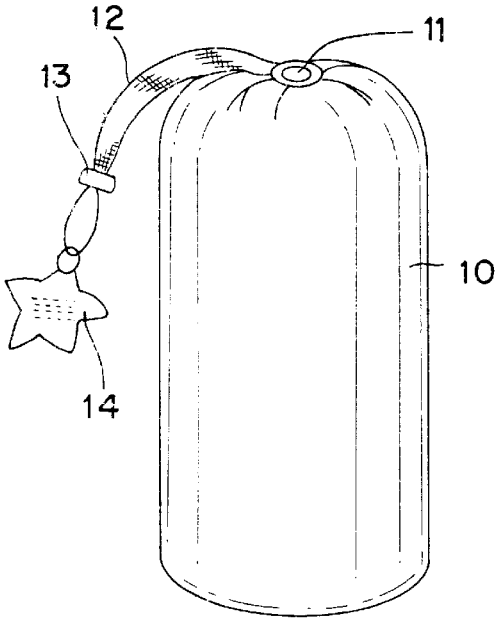
FIG. 2
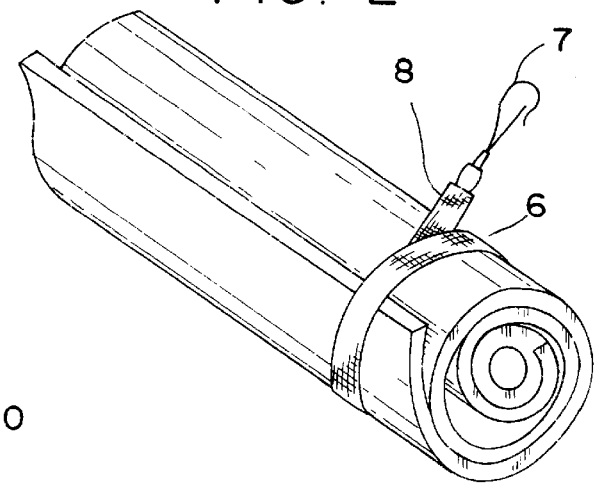
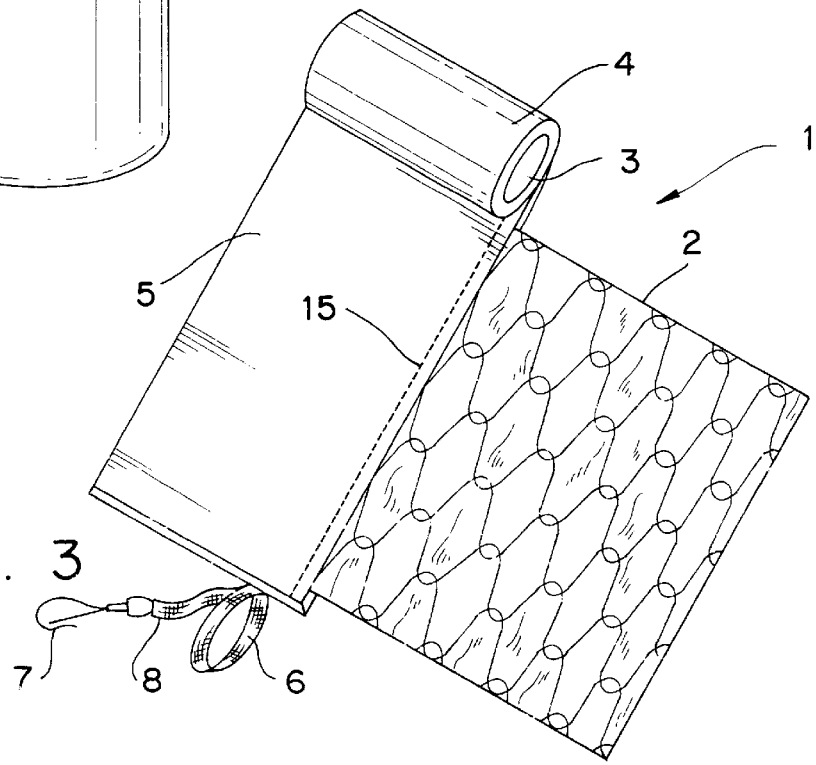
FIG. 3
FIG. 4
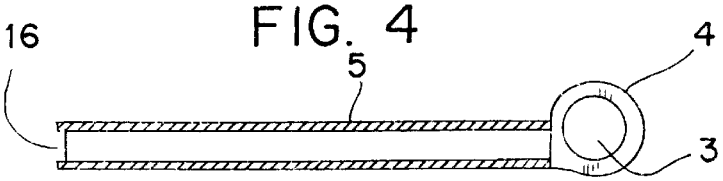

EZ NAP

BACKGROUND OF THE INVENTION

This invention relates, in general, to resting mats, and, in particular, to a resting mat system that can be rolled up for storage and transportation.

DESCRIPTION OF THE PRIOR ART

In the prior art various types of sleeping or resting mats have been proposed. For example, U.S. Pat. No 4,754,512 to Chao-Yang discloses a sleeping mat that has an opening that contains an inflatable air cell for inflating a toy that is attached to the mat.

U.S. Pat. No. 4,967,428 to Browder discloses a resting mat with a pillow secured thereto.

U.S. Pat. No. 5,172,440 to Ming discloses a bag having a toy sewn to the front and a zip fastener to close the bag.

U.S. Pat. No. 5,467,487 to Sicard discloses a beach towel with an opening that functions as a duffel bag and a flip out storage pouch to store accessories such as sunglasses.

SUMMARY OF THE INVENTION

The present invention is directed to a resting mat system for use by children which can be rolled up for storage. The casing of the resting mat system has a quilted blanket attached to one side and a pocket at the top end for insertion of a pillow. The body of the casing creates another pocket at the bottom end into which a foam pad is inserted.

It is an object of the present invention to provide a new and improved resting mat system.

It is an object of the present invention to provide a new and improved resting mat system which can be rolled for storage or transportation.

It is an object of the present invention to provide a new and improved resting mat system which has a pocket for a pillow that is inserted from the side and a blanket attached thereto.

These and other objects and advantages of the present invention will be fully apparent from the following description, when taken in connection with the annexed drawings.

BRIEF DESCRIPTION OF THE DRAWINGS

FIG. 1 is a view of the present invention stored in a washable storage bag.

FIG. 2 is a view of the present invention rolled up for storage or transportation, shown with the storage bag removed.

FIG. 3 is a view of the resting mat system of the present invention in an unrolled condition.

FIG. 4 is a side view showing the pillow pocket of the mat casing of the present invention.

DESCRIPTION OF THE PREFERRED EMBODIMENT

Referring now to the drawings in greater detail, FIG. 3 shows the resting mat system 1 of the present invention unrolled. The resting mat system has a rectangular mat (shown in FIG. 4), although other shapes could be used, which a child can lie on while taking a nap. The mat could be made from any material that will present a comfortable surface for the child to lie on. The mat is preferably made from closed cell foam, although other materials could be used without departing from the scope of the invention.

In addition, the mat is provided with a nylon slip cover and casing 5 that has an opening 16 in one end (see FIG. 4). The mat slides into the opening 16 to provide a comfortable surface for the child to lie on. The nylon slip cover allows easy insertion of the foam mat into the body of casing 5. The casing 5 is preferably made from a washable cotton, although other materials could be used without departing from the scope of the invention.

Integrally attached to the casing 5 is a pillow pocket 4 that is essentially a bag with an opening at one side. The pillow pocket 4 can be attached to the casing 5 in any conventional manner such as, but not limited to, sewing. A pillow 3, such as a polyester fiber pillow, can be slipped into the pillow pocket 4 to be used by the child while resting, and can be easily pulled out of the pillow pocket when it is time to wash the casing 5. By using the pillow pocket 4, the child will always have his/her pillow for comfort.

As seen in FIG. 3, a blanket 2, such as a quilted blanket, is integrally attached along the length of one side, as shown at 15, of the casing 5, and can be used to cover the child when it is time for his/her nap time or resting period. The blanket can not be separated from the casing 5 so as not to become separated from the mat system and become lost.

In order to maintain the mat in a rolled up condition for storage, as shown in FIG. 2, an elastic loop or strap 6 could be attached to one end of the mat or cover by any conventional means. Once the mat is rolled up, the loop 6 could be stretched and passed around one end of the mat, as shown in FIG. 2, to hold the mat in a rolled up condition. Also, it should be noted that pillow pocket 4 and blanket 2 are positioned over the top of casing 5 prior to rolling up the mat. With these items in place, the mat is rolled up and secured with the strap 6. In this manner all the items necessary for a child's nap will be on hand when they are needed.

Also, a spring clip 7, of any conventional design, can be attached to the strap 6 by a loop 8. The clip 7 could be used to attach items such as the drawing string of the storage bag so as not to become separated from the nap system and lost during use. Also, even though only one strap 6 is shown in the drawings, it should be understood that two or more straps could be used if necessary or desired.

FIG. 1 shows a bag 10 that can be used to enclose the resting mat system in order to store them or to keep them clean when they are not in use. The bag can be made from any material such as, but not limited to, vinyl cloth. The bag 10 has an opening 11 at the top which can be closed by means of a drawstring 12. In addition, the drawstrings could have a sliding holder 13, of any conventional design, which will hold the drawstrings and prevent the hole 11 from accidentally opening. Also, a plastic I.D. tag 14 could be attached to the drawstrings, or some other portion of the bag. The plastic I.D. tag 14 could be similar to the baggage tags used on suitcases which allow a user to place his/her name thereon. However, the plastic I.D. tag 14 should be in a shape, such as a star, that would be attractive to children. This will allow each child to have his/her own resting mat system and to know which one is his/hers.

In use, when a child wants to take a nap, he/she will find the proper resting mat system by looking at the tags 14, and then open the bag 10 and remove the resting mat system. The blanket 2 can be unfolded from casing 5 with the pillow stored in pillow pocket 4 and made ready for use.

Although the EZ Nap and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What we claim as our invention is:

1. A resting mat system adapted to be used by children while napping in combination with a storage bag for storing and transporting said resting mat system, said resting mat system comprising:

a bag having a closed bottom and an open top, means for pulling said open top closed, and an identification tag means, secured to said means for pulling said open top closed, for identifying an owner of said resting mat system, said resting mat system comprising:

a casing means for enclosing a mat, said casing means having a length and a width, said casing means having an opening along its width to insert a mat sheathed in a slip cover, a blanket integrally attached to said casing means, said blanket being attached along substantially the entire length of said casing means, means along a single side of said casing means, said casing means having a pillow pocket attached at one end.

2. The resting mat system as claimed in claim 1, wherein said pillow pocket is a hollow portion integrally attached to said casing means, said hollow portion having an opening at one side.

3. The resting mat system as claimed in claim 1, wherein said pillow pocket has a pillow placed therein.

4. The resting mat system as claimed in claim 1, wherein said mat has an elastic securing means attached thereto for holding said mat in a rolled up condition.

5. The resting mat system as claimed in claim 4, wherein said elastic securing means has a resilient clip means attached thereto for securing items to said elastic securing means.

* * * * *